US006863041B2

(12) United States Patent
Nagai et al.

(10) Patent No.: US 6,863,041 B2
(45) Date of Patent: Mar. 8, 2005

(54) ENGINE STARTER

(75) Inventors: Toru Nagai, Tokyo (JP); Hayato Yamauchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/730,973

(22) Filed: Dec. 10, 2003

(65) Prior Publication Data

US 2004/0168666 A1 Sep. 2, 2004

(30) Foreign Application Priority Data

Dec. 10, 2002 (JP) ..... 2002-357848

(51) Int. Cl.[7] ..... F02N 11/00

(52) U.S. Cl. ..... 123/179.25; 290/38 R; 74/7 A

(58) Field of Search ..... 123/179.25; 290/38 R; 74/7 A

(56) References Cited

U.S. PATENT DOCUMENTS 4,418,289 A * 11/1983 Mortensen ..... 307/142
5,325,827 A * 7/1994 Fasola ..... 123/179.3
6,323,562 B1 * 11/2001 Renner et al. ..... 290/38 A
6,360,707 B1 * 3/2002 Boegner ..... 123/179.25
6,516,767 B1 * 2/2003 Maillet et al. ..... 123/179.3
6,634,332 B2 * 10/2003 Saito et al. ..... 123/179.3
6,651,603 B2 * 11/2003 Osada et al. ..... 123/179.3
6,752,111 B2 * 6/2004 Osada et al. ..... 123/179.3

FOREIGN PATENT DOCUMENTS

JP 9-177644 A 7/1997

* cited by examiner

*Primary Examiner*—Henry C. Yuen
*Assistant Examiner*—Arnold Castro
(74) *Attorney, Agent, or Firm*—Sughrue Mion, PLLC

(57) ABSTRACT

An engine starter that rotates at a rated speed after a ring gear meshs with a pinion slowly characterized by a wide variety of tolerance in manufacturing, and the inclusion of a magnet switch having an auxiliary contact being protected from an adverse effect of metal powder that could generate as a result of friction between contacts occurring during the closing and opening of the main contact. The starter comprises a starter motor, a pinion that moves back and forth relative to an engine ring gear to engage or disengage with the ring gear, when driven by the starter motor, main and auxiliary contacts for driving the starter motor by two different speeds, a resistor connected to the auxiliary contact, a plunger assembly that supports the movable contact points of the main and auxiliary contacts and shuttles between the non-working and working positions of the movable contact points, a switch coil causing the plunger assembly to move to put the main and auxiliary contacts in and out of contact, and a starter switch including a driving mechanism causing the pinion to advance toward and recede from the ring gear.

5 Claims, 4 Drawing Sheets

ENGINE STARTER

BACKGROUND OF THE INVENTION

This invention relates to an engine starter for use in starting up an internal combustion engine.

In an electromagnetic switch included in a conventional auxiliary rotary engine starter, main and auxiliary contacts are mounted for a two-step control of the motion of the starter motor at the start-up of the engine, a resistor is connected in series to the circuit formed when the auxiliary contact is closed, and the armatures of a battery and a motor are connected. On the other hand, the armatures of a battery and a motor are connected directly to the circuit formed when the main contact is closed. When the starting switch is turned on, electric current is supplied to a coil for pulling a movable member that causes the auxiliary contact to close. When the auxiliary contact is closed, electric current flows from the battery to the armature of the motor through the resistor to cause a pinion mounted on a motor axis to engage with a ring gear. Following the pinion-ring gear engagement, the main contact is closed and the starter motor rotates at a rated speed. In such an engine starter, main and auxiliary contacts are mounted on separate plungers (see, for example, Japanese Patent Laid-Open No. 07-109967, Para. 0009, FIG. 1)

Trouble with such an engine starter is that the starter itself must be large because it includes more than one plunger for driving main and auxiliary contacts separately, and it is difficult to lay out the terminals neatly. Thus, an engine starter wherein such size-reducing measure as the use of a movable contact point in common for closing and opening main and auxiliary contacts and the provision of an electromagnetic switch having a built-in resistor has been proposed (see, for example, Japanese Patent Laid-Open No. 07-174062, Para. 0009, FIG. 2).

Further, in such an electromagnetic switch wherein a coil for pulling a movable member is strengthened for the purpose of pulling the movable member more quickly, an induced counter electromotive force causing a difficulty in holding in place the movable member could generate following the release of the electromagnetic switch. A model wherein a single coil with a high impedance is used as a coil for driving a movable member and the main and auxiliary contacts are closed and opened with a time lag by connecting a resistor built-in in an electromagnetic switch in series to the auxiliary contact for supplying electric current to the armatures of the motor, as a measure for reducing induced counter electromotive force, has been proposed (see, for example, Japanese Patent Toku-hyou Laid-open 2001-508855).

In the conventional electromagnetic switch, an auxiliary contact is disposed in a contact room together with the main contact, and such an auxiliary contact is small and is given a narrow contact gap. Therefore, powders of copper generating upon the bouncing and abrasion of the movable contact point on the stationary contact points could deposit on the surfaces of the movable and stationary contact points of the auxiliary contact and could inhibit insulation, thus inducing such a trouble as a start-up failure.

The present invention has as its object the provision of an engine starter characterized by the rotation at a rated speed of the starter motor occurring after a slow engagement of the ring gear with the pinion, a wide tolerance for dimension in manufacture and the mounting of an electromagnetic switch including an auxiliary contact free from the effect of metal powders generated upon the closing and opening of the main contact.

SUMMARY OF THE INVENTION

An engine starter according to the present invention comprises a starter motor, a pinion that advances to or recedes from a ring gear of an engine to engage or disengage with said ring gear, when driven by said starter motor, main and auxiliary contacts for driving said starter motor by two different speeds, a resistor connected to said auxiliary contact, a plunger assembly that supports movable contact points of said main and auxiliary contacts and shuttles between the non-working and working positions of said movable contact points, a switch coil that causes said plunger assembly to move to put said main and auxiliary contacts in and out of contact, and a starter switch including a driving mechanism causing said pinion to advance to and recede from said ring gear, wherein a separator is provided between said main and auxiliary contacts.

DETAILED DESCRIPTION OF THE PREFERRED EMBODIMENTS

Embodiment 1

Figure 1:
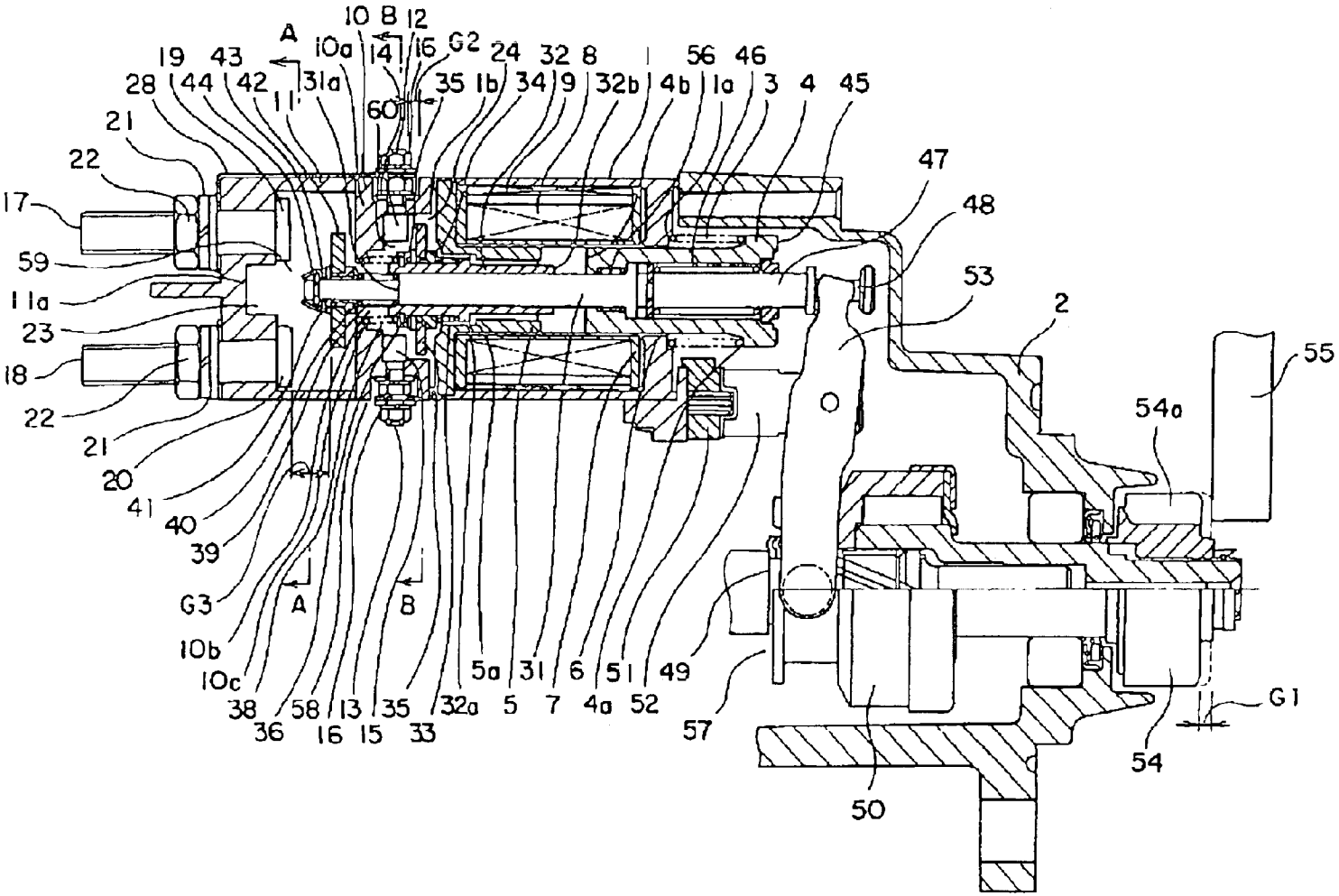
FIG. 1 is a cross-sectional view of an engine starter embodying the present invention.

FIG. 1 is a cross-sectional view of an engine starter embodying the present invention. The engine starter is provided with a magnetically permeable pot-shaped casing 1, a movable rod 4 in the form of a cylinder that moves between the unoperated and operated positions thereof along the central axis of the casing 1 and is biased toward a front bracket 2 by a movable rod return spring 3 disposed between an end face 1*a* toward the front bracket 2 of the casing 1 and a stepped periphery 4*a* formed in the movable rod 4 round its end toward the front bracket 2, and an electromagnetic core 5 that is caulked at a holding section 1*b* of the casing 1, faced to the movable rod 4 and has a penetrating hole 5*a* in the center thereof, for the purpose of forming a magnetic circuit needed to drive the movable rod 4.

The engine starter is further provided with a guide sleeve 6 in the form of a cylinder for surrounding the outer periphery of the movable rod 4 and slidably guiding the movable rod 4, a coil housing 7 concentrically surrounding the sleeve 6, a switch coil 8 housed within the coil housing 7, and a resistor 9 disposed between the switch coil 8 and the casing 1 in the manner in which a gap is given between the resistor 9 and the switch coil 8, whereby the magnetic energy for driving the movable rod 4 is supplied to the magnetic circuit.

The engine starter is further provided with a cup-shaped first switch cover 10 fastened to the electromagnetic core 5 at the end thereof opposite to the end toward the front bracket 2 and a cup-shaped second switch cover 11 fastened to the first switch cover 10 at the end thereof opposite to the end toward the front bracket 2. Also provided are a set of two first bolt terminals 12 and 13 penetrating the cylindrical side wall of the first switch cover 10, auxiliary stationary contact points 14 and 15 fastened to the respective inner ends of the first bolt terminals 12 within the first switch cover 10, and two-stepped nuts 16 each fastened to the screwed section formed in each of the first bolt terminals 12 and 13 at each bolt terminal's end outside the first switch cover 10. The engine starter is also provided with a set of two second bolt terminals 17 and 18 penetrating an end 11*a* of the second switch cover 11 facing to the first switch cover 10 and fastened to the second switch cover 11. Main stationary contact points 19 and 20 are fastened to the respective inner ends of the second bolt terminals 17 and 18 within the second switch cover 11, and nuts 22 are fastened to each of the second bolt terminals 17 and 18 with flat washers 21 at the outer ends of the terminals outside the second switch cover 11.

The first switch cover 10 and the second switch cover 11 define therein a main contact room 23 and an auxiliary contact room 24, and the auxiliary stationary contact points 14 and 15 constitute an auxiliary stationary contact point pair 25, and the main stationary contact points 19 and 20 constitute a main stationary contact point pair 26. A hole 10*b* is formed in the center of the bottom wall 10*a* of the cup-shaped first switch cover 10 facing to the main contact room 23, and the bottom wall 10*a* functions as a separating wall 27 separating the main contact room 23 from the auxiliary contact room 24.

Figure 4:
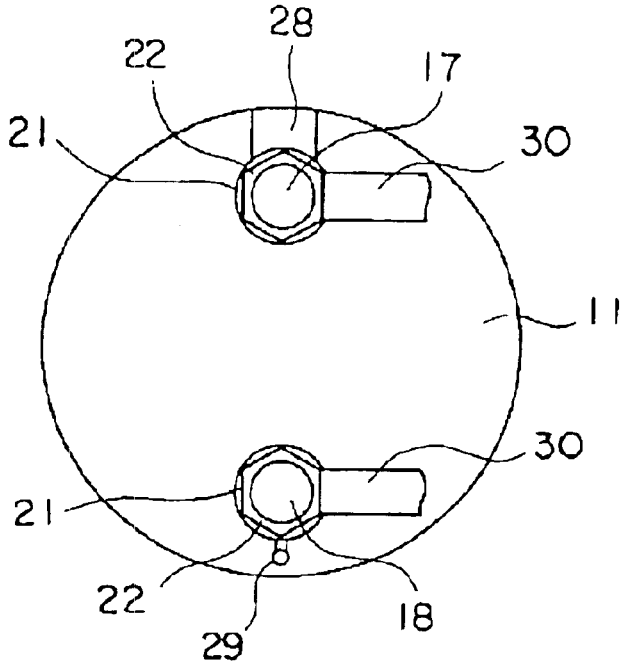
FIG. 4 is a side view of the engine starter of FIG. 1.
Figure 5:
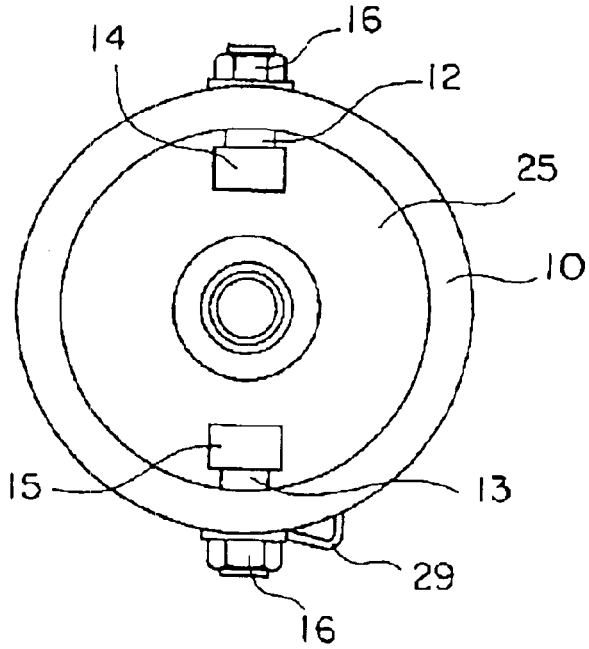
FIG. 5 is a cross-sectional view of the engine starter along line B—B of FIG. 1.

The engine starter is further provided with a conductive terminal 28 connecting the first bolt terminal 12 and the second bolt terminal 17, a lead wire 29 of the resistor 9 connected to both the first bolt terminal 13 and the second bolt terminal 18, a connecting line 30 drawn from the battery and connected to the second bolt terminal 17 and another connecting line 30 connected to the motor and the second bolt terminal 18 (see FIGS. 1, 4 and 5).

The engine starter is further provided with a contact shifting rod 31 that consists of two portions of which the one toward the main contact room 23 has a diameter smaller than that of the other, thus giving a two-stepped periphery to the rod, is fitted in a penetrating hole 4*b* of the movable rod 4 and extends up to the main contact room 23. Slidably disposed on the contact shifting rod 31 in close contact with the outer surface of the intermediate section of the contact shifting rod 31 is a first insulating bushing 32 that has a raised section 32*a* at about half way of its length. An auxiliary movable contact point pushing spring 33 is disposed on the first insulating bushing 32 so that it abuts at one end thereof against the side face of the raised portion 32*a* of the first insulating bushing 32 on the side close to the auxiliary contact room 24, and an insulating bracket 34 that has the form of a two-stepped ring is supported by the auxiliary movable contact point pushing spring 33 at the end opposite to the end abutting on the raised portion 32*a* of the insulating bushing 32 and is disposed around the first insulating bushing 32 for sliding along the outer surface of the insulating bushing. An auxiliary movable contact point 35 that is disc-shaped is secured to the outer surface of the smaller ring of the first insulating bracket 34. A holder 36 and a retaining ring 37 are mounted on the insulating bushing 32 at the bushing's end toward the auxiliary contact room 24, and an elastic member 38 such as a coil spring is disposed between the retaining ring 37 and the stepped section 10*c* formed in the end toward the auxiliary contact room 24 of the first switch cover 10 to urge the first insulating bushing 32 toward the front bracket 2. A main contact point pushing spring 39 is disposed to abut at one end thereof against a step 31*a* of the stepped periphery of the contact shifting rod 31, and a second insulating bracket 40 in the form of a two-stepped ring, that is supported by the main contact point pushing spring 39 at the end opposite to the end abutting on the contact shifting rod 31 is disposed around the outer surface of the contact shifting rod 31 for sliding movement along the outer surface of the contact shifting rod 31. A main movable contact point 42 is disposed in close contact with the outer periphery of the portion-with smaller diameter of the second insulating bracket 40 and in the space between the step formed in the second insulating bracket 40 at the section where the ring diameter is reduced and an insulating washer 41, and a holder 43 and a retaining ring 44 are provided in order to limit the movement of the main movable contact point 42 toward the main stationary contact point pair 26. Thus, the movable contact of the electromagnetic switch is constituted with the above-described arrangement.

The engine starter is further provided with a ring 45 fastened to the movable rod 4 at the end thereof toward the front bracket 2, a shaft 47 urged by a spring 46 to abut against the contact shifting rod 31 at the rod end toward the front bracket 2 and, an insulating bushing 48 disposed on the shaft 47 at the end toward the front bracket 2, a lever 53 in the form of a claw held by a lever holding section 51 via a lever spring 52 with one end of the lever 53 supported rotatably by the insulating bushing 48 and the other end thereof supported rotatably by a clutch 50 inserted into a rotary shaft 49 of the motor of the engine starter, and a pinion 54 mounted on the tip of the clutch 50, for the purpose of inducing the rotation of the rotary shaft of an internal engine by putting the pinion 54 in and out of engagement with a ring gear 55 of the internal engine.

A plunger assembly 56 comprises the movable rod 4, the contact shifting rod 31 fastened to the movable rod 4 and the shaft 47, and these movable members move between their respective unoperated and operated positions thereof.

The pinion 54 is driven forward and backward by a driving mechanism 57. The driving mechanism 57 is provided with the lever 53 connected to the shaft 47 and the clutch 50.

The main contact room 23 is separated from the auxiliary contact room 24 by a separator 58, and the separator 58 comprises a separating wall 27 and the elastic member 38.

A main contact 59 of the starter switch comprises the main movable contact point 42 and the main stationary contact point pair 26. An auxiliary contact 60 comprises the auxiliary movable contact point 35 and the auxiliary stationary contact point pair 25. The main contact 59 makes or breaks a connection of a battery 61 to a starter motor 62, while the auxiliary contact 60 makes or breaks a connection of the battery 61 to the starter motor 62 through the resistor 9.

In the engine starter, electric current is supplied to the switch coil 8 to energize the magnetic circuit and thereby to move the movable rod 4 forward and backward (left and right in FIG. 1). The unoperated position of the movable rod 4 is a position in which no electric current is supplied to the switch coil 8, and the movable rod 4 remains in the position wherein the rod is connected to the clutch 50 stopped by an unillustrated stopper mounted on the rotating axis 49 and therefore remains static. The gap G1 between the pinion 54 and the opposing end surface of the ring gear 55 is the distance between the pinion 54 in its unoperated position, or the position wherein the pinion 54 is connected to the clutch 50 stopped by the unillustrated stopper and the pinion 54 in its position wherein the ring gear 55 is in abutment with the end surface of the pinion 54 but not in engagement with the spline 54*a* of the pinion 54.

The auxiliary contact gap G2 between the auxiliary movable contact point 35 and the auxiliary stationary contact points 14 and 15 is the distance between the auxiliary movable contact 35 pinion 54 in its unoperated position, or the position wherein the raised portion 32*a* of the insulating bushing 32 abuts against and held at the step portion 5*a* of the magnet core 5 and the auxiliary stationary contact points 14 and 15.

(gap G2) when the auxiliary movable contact point 35 is in its non-working position, or the position of contact point 35 when the raised portion 32*a* of the insulating bushing 32 remains static following abutting on the step portion 5*a* of the electromagnetic core 5.

The insulating bushing 32 is in its unoperated position when the raised portion 32*a* thereof is held stationary at the stepped section 5*a* of the electromagnetic core 5 and the insulating bushing is biased toward the front bracket 2 by the elastic member 38.

A main contact point gap G3 between the main movable contact point 42 and the main stationary contact points 19 and 20 is the distance between the main movable contact point 42 in its unoperated position, or the position of the main contact point 42 when the movable rod return spring 3 urges the movable rod 4 toward the right in FIG. 1 to hold the clutch 50 at the stopper through the lever spring 52 and the main stationary contact points 19 and 20.

When it is assumed that the maximum distance of travel of the movable rod 4 when the electric current supply to the switch coil 8 is made on and off is L (mm), the contact shifting rod 31 moves an equal distance. A gap defined between the end surface 4*b* opposing to the magnet core 5 of the movable rod 4 and the end surface opposing to the movable rod 4 of the insulating bushing 32 in the unoperated position is assumed to be Q (mm), the auxiliary contact point 35 is closed when the movable rod 4 moves by a distance (Q+G2)(mm). Assuming that the contact pressure distance of the auxiliary movable contact point 35 is K1 (mm), then K1 is (L−Q−G2)(mm). The main movable contact point 42 is closed when and movable rod 4 moved by the distance G3 (mm), and when the contact pressure distance of the main movable contact point 42 is assumed to be K2 (mm), K2 is (L−G3).

On the other hand, the travel distance P (mm) of the shaft 47 is smaller than the travel distance L of the movable rod 4 by an amount of compression M (mm) of the lever spring 46 because of the compression of the lever spring 46 when the shaft 47 moves to the left in FIG. 1, the distance P (mm) is (L−M)(mm). A gap is therefore provided between the contact shifting rod 31 and the shaft 47.

As seen in FIG. 1, the main contact gap G3 is almost equal to the sum of the auxiliary contact gap G2 and gap Q, while the sum of the auxiliary contact gap G2 and gap Q is larger than the sum of the gap G1 between the ring gear and the pinion and the compression amount M of the lever spring.

Figure 6:
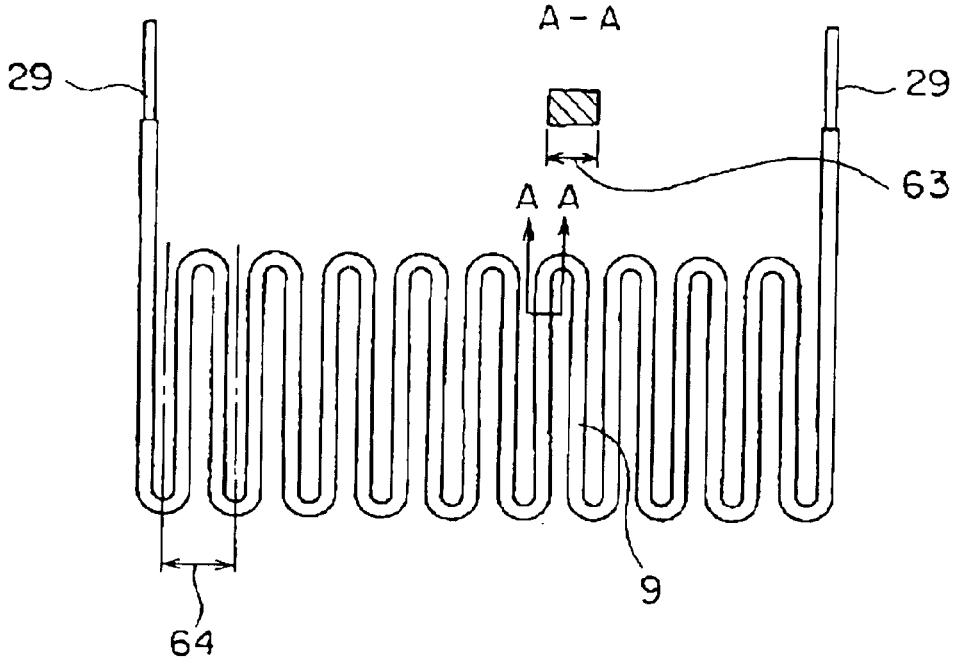
FIG. 6 is an expansion plan of the resistor of the engine starter of FIG. 1.

The resistor 9 is constructed from a resistance plate made of a copper-nickel alloy, and It is possible to attain preferred levels of resistance and rated power in the resistor 9 by selecting a width 63 and a pitch 64 as shown in FIG. 6. That is, in order to increase the rated power, the width 63 may be increased and the pitch 64 may be correspondingly decreased to increase the number of turns, enabling to easily obtain the resistor 9 having a different rated power but the same resistance. The resistor 9 is manufactured by insert molding within a phenol resin a metal sheet punched into a serpentine configuration and bent into a cylindrical shape. The outer diameter of the cylindrical resistor 9 is substantially equal to the inner diameter of the casing 1 so that the resistor 9 can be intimately fitted within the casing 1. The inner diameter of the resistor 9 on the other hand is larger than the outer diameter of the switch coil 8.

The opening and closing timing of the main and auxiliary contacts of the engine starter will now be described. As shown in the circuit diagram in FIG. 2, when a starting switch 65 is turned on, an electric current is supplied from the battery 61 to the switch coil 8 to induce a magnetic force that attracts the movable rod 4 toward the electromagnetic core 5, then the movable rod 4 is moved to the left in FIG. 1 while compressing the moving return spring 3. As a result, the insulating bushing 48 connected to the shaft 47 moves to the left in FIG. 1, causing the lever 53 to turn counterclockwise on a lever holder 52, and the pinion 54 is moved to the right in FIG. 1 till it abuts on the end surface of the ring gear 55. During this movement, although the movable rod 4 is also moved by the distance G1, since G2+Q is larger than the gap G1, the auxiliary movable contact point 35 does not abut against the auxiliary stationary contact points 14 and 15. When the end surface of the pinion 54 abuts the ring gear 55, the holding point on the lever 53 supported by the clutch 50 is not permitted to move. However, due to the force pulling the movable rod 4 toward the left in FIG. 1, the lever spring 46 flexes to permit the movable rod 4 advances till it abuts on the end facing to the movable rod 4 of the electromagnetic core 5 while pushing the insulating bushing 32, thereby the auxiliary movable contact point 35 moves to the left in FIG. 1 till it contacts the auxiliary stationary contact points 14 and 15. When the auxiliary movable contact point 35 is brought into contact with the stationary contact points 14 and 15, an electric current flows from the battery 61 to the starter motor 62 through the resistor 9. Because this electric current flows through the resistor 9, the current value increases slowly and the rotation rate of the starter motor 62 also increases slowly. The ring gear 55 therefore engages slowly with a spline 54*a* of the pinion 54 while being guided by the end surface of the pinion 54.

When the ring gear 55 engages with the spline 54*a* of the pinion 54, the contact shifting rod 31 also moves to the left in FIG. 1 to bring the main movable contact point 42 in contact with the main stationary contact points 19 and 20. Consequently, an electric current flows from the battery 61 to the starter motor 62 through the main contact, causing the starter motor 62 to rotate at a rated speed to start the engine.

When the main contact 59 is closed, since the resistor 9 is connected between the auxiliary contacts 60, the impedance in the circuit on the side of the auxiliary contact 60 become by far higher than that in the circuit on the side of the main contact 59, no significant amount of electric current flows through the circuit at the side of the auxiliary contact 60.

The auxiliary movable contact point 35 is biased by the elastic member 38 toward the front bracket 2, and the movable rod 4 is also biased toward the front bracket 2 by the movable rod return spring 3 in the compressed state.

When the engine is started, the starting switch 65 is turned off to interrupt the voltage supply onto the switch coil 8 and the attractive force acting on the movable rod 4 to the right in FIG. 1 is eliminated, whereby the movable rod 4 is moved to the right in FIG. 1 by the spring action of the movable rod return spring 3. Consequently, the contact shifting rod 31 connected to the movable rod 4 moves to the right in FIG. 1 to cause the main movable contact point 42 to separate from the main stationary contact points 19 and 20. At the same time, the movable rod 4 is separated from the insulating bushing 32 and the auxiliary movable contact point 35 is moved quickly to the right in FIG. 1 due to the resilience of the elastic member 38, thus opening the auxiliary contact 60. Even if the pinion 54 cannot move smoothly during this operation due to friction with the ring gear 55, there is no continuous flow of large electric current into the resistor 9 because the auxiliary contact 60 is permitted to independently separate from the operated position.

Figure 2:
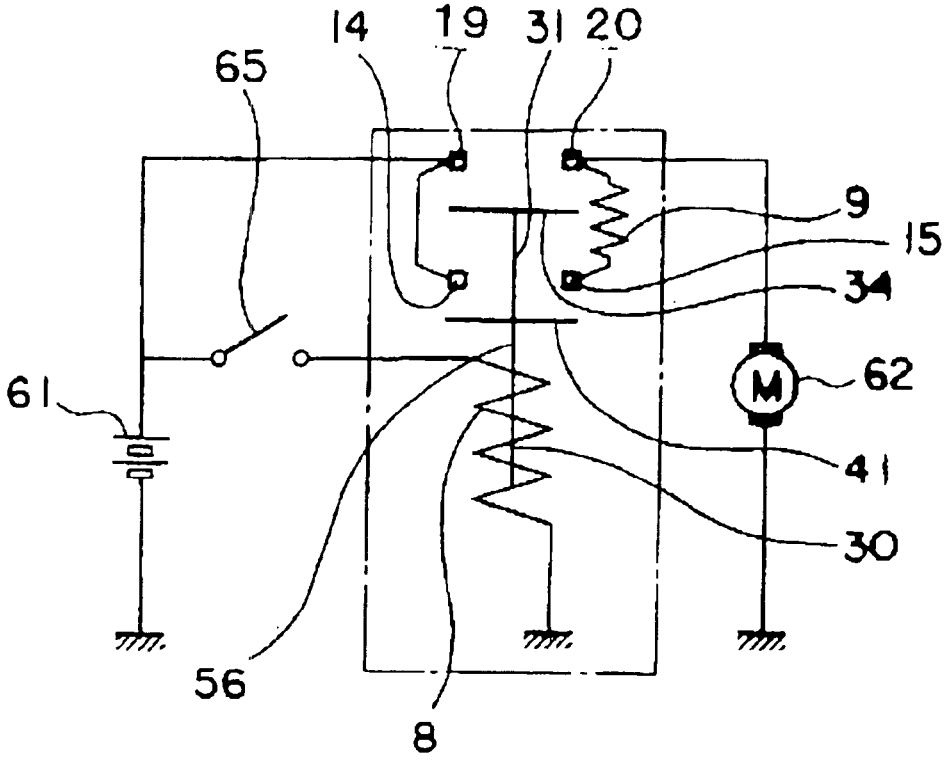
FIG. 2 is a circuit diagram of the engine starter of FIG. 1.
Figure 3:
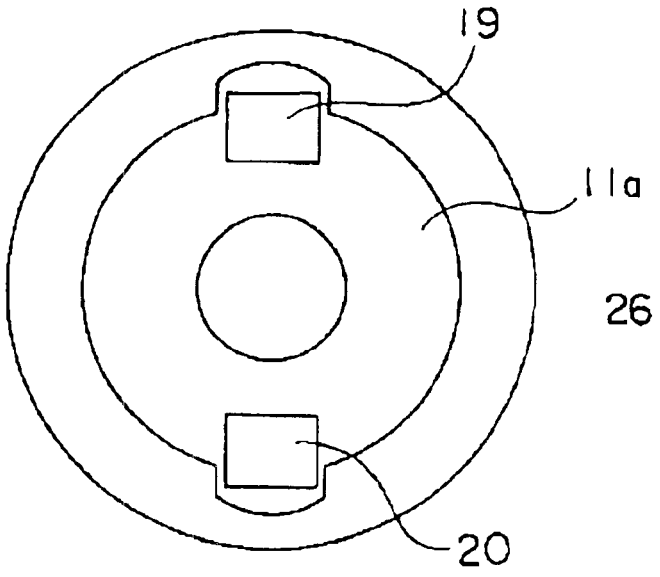
FIG. 3 is a cross-sectional view of the engine starter along line A—A of FIG. 1.

The engine starter of the present invention arranged in the circuit illustrated in FIG. 2 was checked as to the opening and closing states of the auxiliary contact by repeatedly performing the starting of the internal combustion engine and it was confirmed that the auxiliary contact was stably separated at the timing it should be separated and there was no electric current flowing into the resistor.

Following the repeated starting of the engine, the stationary contact points in the main and auxiliary contact rooms were observe and found that there was no significant deposit of metal powders or the like seen in the main contact room on the surface of the auxiliary contact.

In the engine starter structured like this, it is possible to prevent the auxiliary contact room from being contaminated by metal powders that could generate during the closing and opening of contacts in the main contact chamber.

Further, drift of metal powder from the main contact room to the auxiliary contact room can be prevented by the compression of the auxiliary movable contact point return spring.

Further, when the starter coil is excited, the ring gear abuts against the opposing end surface of the pinion that is not yet rotated and thereafter the auxiliary contact is closed to allow an electric current to flow through the series-connected circuit, whereupon the ring gear slides on the end surface of the pinion that is now started to slowly rotate to eventually engage with the spline of the pinion, thus alleviating the improper engagement between the pinion and the ring gear.

Further, when the excitation of the starter coil is interrupted to return the movable rod to its unoperated position, the contact shifting rod is moved by the movable rod 4 after the closure of the main contact irrespective of the return movement of the shaft, so that the auxiliary contact opens following the opening of the main contact without delay and no electric current flows into the resistor.

Further, since the main contact gap and the auxiliary contact gap can be independently determined, the precision of assembly needs not be particularly high, providing a saving of manufacturing cost.

Further, even when the assembly is achieved with a standard level of precision, the auxiliary contact is not closed upon the abutment of the ring gear against opposing end surface of the pinion and the auxiliary contact closes only after the lever spring flexes.

Further, when the ring gear initiates the engagement with the spline of the pinion, the ring gear engages quickly with the spline due to the spring action of the lever spring, and consequently the ring gear and the pinion rotate while engaging with a wide area of contact, so that the ring gear and the pinion suffer from a lesser damage at their abutting surfaces.

Embodiment 2

Figure 7:
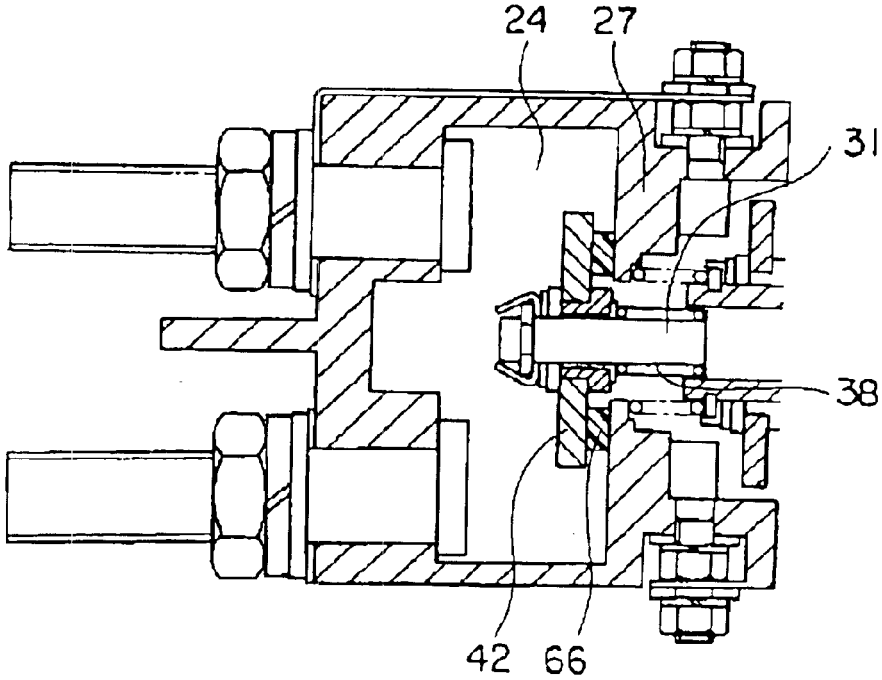
FIG. 7 is a cross-sectional view of the main and auxiliary contact rooms formed in an engine starter also embodying the present invention.

FIG. 7 is a sectional view of the main and auxiliary contact rooms of the engine starter of another embodiment of the present invention. In the engine starter shown in FIG. 7 an elastic member 66 such as bellows is fastened to the side of the separating wall 27 facing toward the main contact room 24 and a contact shifting rod 31 is passed through a hole 27*a* formed in the separating wall 27 and the elastic member 66 and extends into the main contact room 24. The main movable contact point 42 supported by the main contact pushing spring 39 on the contact shifting rod 31 connected to the movable rod 4 (FIG. 1) in the unoperated position is brought into contact with the end portion of the elastic member 66 at the surface of the main movable contact point 42 facing the elastic member 66. When the switch coil 8 (FIG. 1) is excited to move the contact shifting rod 31 to the left in FIG. 7, the elastic member 66 expands while keeping contact with the main movable contact point 42.

The engine starter of the present invention arranged in the circuit illustrated in FIG. 2 was checked as to the opening and closing states of the auxiliary contact by repeatedly performing the starting of the internal combustion engine and it was confirmed that the auxiliary contact was stably separated at the timing it should be separated and there was no electric current flowing into the resistor.

Following the repeated starting of the engine, the stationary contact points in the main and auxiliary contact rooms were observe and found that there was no significant deposit of metal powders or the like seen in the main contact room on the surface of the auxiliary contact.

In the engine starter structured like this, it is possible to prevent the auxiliary contact room from being contaminated by metal powders that could generate during the closing and opening of contacts in the main contact chamber.

It is to be noted that while an elastic member which is bellows is provided on the partition wall in this embodiment, the contamination of the auxiliary contact room can be alleviated when an elastic member such as ordinary spring is disposed coaxially with respect to the shifting shaft.

As has been described, the engine starter according to the present invention has the advantages described below.

The engine starter comprises a starter motor, a pinion that advances to or recedes from a ring gear of an engine to engage or disengage with said ring gear, when driven by said starter motor, main and auxiliary contacts for driving said starter motor by two different speeds, a resistor connected to said auxiliary contact, a plunger assembly that supports movable contact points of said main and auxiliary contacts and shuttles between the non-working and working positions of said movable contact points, a switch coil that causes said plunger assembly to move to put said main and auxiliary contacts in and out of contact, and a starter switch including a driving mechanism causing said pinion to advance to and recede from said ring gear, wherein a separator is provided between said main and auxiliary contacts. Therefore, the contamination of the auxiliary contact room by metal powders that generate in the main contact room during the closing and opening of the contacts can be prevented.

What is claimed is:

1. An engine starter comprising:

a starter motor;

a pinion that advances to or recedes from a ring gear of an engine to engage or disengage with said ring gear, when driven by said starter motor; main and auxiliary contacts for driving said starter motor by two different speeds;

a resistor connected to said auxiliary contact;

a plunger assembly that supports movable contact points of said main and auxiliary contacts and shuttles between the non-working and working positions of said movable contact points;

a switch coil that causes said plunger assembly to move to put said main and auxiliary contacts in and out of contact; and a starter switch including a driving mechanism causing said pinion to advance to and recede from said ring gear, wherein a separator is provided between said main and auxiliary contacts.

2. An engine starter as claimed in claim 1, wherein said separator is provided with a separating wall having a hole penetrating said wall and allowing said plunger assembly to go through and separating said main contact from said auxiliary contact, and an elastic member disposed between said separating wall and said plunger assembly in the manner in which the elastic member encloses said hole.

3. An engine starter as claimed in claim 1, wherein said movable contact points of said main and auxiliary contacts are mounted on said plunger assembly independently each other.

4. An engine starter as claimed in claim 1, wherein a gap is present between a contact shifting rod and a shaft at their ends facing to each other when said plunger assembly including said shifting rod and said shaft is in its working position.

5. An engine starter as claimed in claim 1, wherein said auxiliary contact being connected with said resistor in series is closed by the flexure of a lever spring supporting a lever mounted on said driving mechanism that occurs after the abutting of said ring gear at its end facing said pinion on said pinion at its end facing said ring gear following the movement of said plunger from its non-working position.

* * * * *